US011713635B2

(12) United States Patent
Saeed et al.

(10) Patent No.: US 11,713,635 B2
(45) Date of Patent: Aug. 1, 2023

(54) MOBILITY PLATFORM FOR EFFICIENT DOWNHOLE NAVIGATION OF ROBOTIC DEVICE

(71) Applicant: Saudi Arabian Oil Company, Dhahran (SA)

(72) Inventors: Abubaker Saeed, Dhahran (SA); Shazad Sadick, Brooklyn, NY (US); Jeffrey Shasho, Brooklyn, NY (US); Jonathan Bohren, Brooklyn, NY (US); Narmeen Khan, Brooklyn, NY (US); Elijah Pivo, Brooklyn, NY (US); Anthony Musco, Brooklyn, NY (US); Lonnell Ahiyya, Brooklyn, NY (US)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 14 days.

(21) Appl. No.: 17/006,232

(22) Filed: Aug. 28, 2020

(65) Prior Publication Data

US 2022/0065058 A1 Mar. 3, 2022

(51) Int. Cl.
*E21B 47/08* (2012.01)
*E21B 23/14* (2006.01)
(Continued)

(52) U.S. Cl.
CPC ..... *E21B 23/001* (2020.05); *E21B 23/14* (2013.01); *E21B 47/08* (2013.01); *E21B 47/13* (2020.05)

(58) Field of Classification Search
CPC ..... E21B 23/001; E21B 23/14
See application file for complete search history.

(56) References Cited

U.S. PATENT DOCUMENTS 8,446,492 B2 5/2013 Nakano et al.
9,885,218 B2 2/2018 Heijnen et al.
(Continued)

FOREIGN PATENT DOCUMENTS

CN 102720477 A 10/2012
CN 104634373 A 5/2015
(Continued)

OTHER PUBLICATIONS

Rudakevych, Pavlo. "Fuel Cells for Robots." Office of Energy Efficiency & Renewable Energy, www1.eere.energy.gov/hydrogenandfuelcells/pdfs/128.pdf. 25 pages.
(Continued)

*Primary Examiner* — Robert E Fuller
(74) *Attorney, Agent, or Firm* — Leason Ellis LLP

(57) ABSTRACT

A modular mobility platform has extendable and retractable tractor treads for engaging the walls of a downhole environment. The extendable and retractable tractor treads allow the platform to successfully navigate longitudinally through the downhole environment. The platform is composed of a plurality of different modules removably interconnected together longitudinally. Each module has at least one specific function, such as sensing, navigation, mobility, control, communication, power, or a combination thereof. The platform has longitudinally-directed detectors for detecting the forward or reverse direction through which the platform is to travel. A system and method use the modular mobility platform.

20 Claims, 7 Drawing Sheets

(51) Int. Cl.
*E21B 23/00* (2006.01)
*E21B 47/13* (2012.01)

(56) References Cited

U.S. PATENT DOCUMENTS

| | | | | |
|---|---|---|---|---|
| 2006/0180318 | A1 | 8/2006 | Doering et al. | |
| 2014/0054031 | A1* | 2/2014 | Heijnen | E21B 23/14 166/250.17 |
| 2014/0116729 | A1* | 5/2014 | Al-Mulhem | E21B 23/14 166/243 |
| 2016/0281450 | A1 | 9/2016 | Bloom et al. | |
| 2019/0203544 | A1* | 7/2019 | Saeed | E21B 17/1014 |
| 2020/0300053 | A1* | 9/2020 | Fernandes | F16L 55/46 |

FOREIGN PATENT DOCUMENTS

| | | | |
|---|---|---|---|
| CN | 108999582 | B | 11/2019 |
| CN | 108868603 | B | 12/2019 |
| WO | 9812418 | A2 | 3/1998 |
| WO | 2005068773 | A1 | 7/2005 |
| WO | 2019119083 | A1 | 6/2019 |

OTHER PUBLICATIONS

"Autonomous Tractoring." Offshore Engineer Magazine, Mar. 11, 2014, www.oedigital.com/component/k2/item/5204-autonomous-tractoring). 3 pages.

Fox, Bill. "I, Robot Entrepreneur: Part 2 an Industry at an Inflection Point? ." I, RobotEntrep-2-Industryat Inflection.html, America First Trust , Feb. 2005, www.amfir.com/AmFir/Commentary%20Pages/EditorialsArticles/I,%20Robot%20Investor/I,%20RobotEntrepPart-2-%20IndustryatInflection.html. 9 pages.

Extended European Search Report in corresponding EP Application No. 21192118.4 dated Dec. 17, 2021; 10 pages.

Office Action in corresponding Saudi Arabian Patent Application No. 121430066, dated Mar. 31, 2023; 6 pages.

* cited by examiner

MOBILITY PLATFORM FOR EFFICIENT DOWNHOLE NAVIGATION OF ROBOTIC DEVICE

FIELD OF THE DISCLOSURE

The present disclosure relates generally to geological drilling and downhole procedures, and, more particularly, to a modular mobility platform configured to travel through diverse downhole environments, and to a system and method using such a modular mobility platform.

BACKGROUND OF THE DISCLOSURE

During procedures in geological environments, such as a downhole of a well or pipe, it is advantageous to explore the environment and to inspect the walls of the well using robots or mobility platforms having electronic-based instruments. However, travel of a robot through a downhole longitudinally, such downhole environments, has presented challenges to known robots, since the lateral width within such environments can various substantially. Accordingly, the sides of the robot can brush against or collide with the walls, potentially damaging the robot and its instruments.

Many robots in the prior art also have a fixed structure, such as a housing for retaining a fixed set of motors for travel, as well as a fixed set of instruments for monitoring and inspecting the downhole environment. However, once such robots are constructed, the robot cannot be modified without disassembling the robot, if possible. Therefore, a robot in the prior art is limited to its motors and instruments included during construction.

There are other limitations of known robots that have been used in downhole environments. It is to these constraints that the present disclosure is directed.

SUMMARY OF THE DISCLOSURE

According to an embodiment consistent with the present disclosure, a modular mobility platform has extendable and retractable tractor treads for engaging the walls of a downhole environment. Such tractor treads allow the platform to successfully navigate longitudinally through the downhole environment. Moreover, the platform can be composed of a plurality of different modules removably interconnected together longitudinally. Each module can have a specific function, such as sensing, navigation, mobility, control, communication, and power. The platform can have generally longitudinally-directed detectors for detecting the forward or reverse direction through which the platform is to travel. The present disclosure also includes a system and method using such a modular mobility platform.

In an embodiment, a mobility platform is capable of traveling in a downhole environment. The mobility platform includes a sensor module, which is configured to detect a feature of the downhole environment. The mobility platform also includes a computing module configured to determine a first width of an upcoming portion of the downhole environment from the feature. The mobility platform further includes a drive module having extendable and retractable tractor treads. The computing module is further configured to control the drive module to extend or retract the tractor treads to a second width less than a first width to fit the mobility platform in the upcoming portion. The computing module also controls the drive module to drive the tractor treads to move the mobility platform in the upcoming portion. The sensor module, computing module, and drive module can be interconnected. Furthermore, the sensor module, computing module, and drive module can be removably interconnected. Each of the sensor module, computing module, and drive module have housings that are substantially cylindrical with a respective module longitudinal axis. The sensor module, computing module, and drive module are interconnected with the respective longitudinal axes substantially aligned to form the mobility platform and to define a substantially cylindrical shape along a mobility platform longitudinal axis. The tractor treads are extended or retracted laterally relative to the mobility platform longitudinal axis. The sensor module includes a sensor emitting a detection signal in a forward direction at an acute angle to the mobility platform longitudinal axis for detecting the feature. The computing module controls the drive module using wireless signals.

In another embodiment, a system comprises a control apparatus having a controller for a user to enter a command, and a mobility platform capable of traveling in an downhole environment. The mobility platform includes a sensor module configured to detect a feature of the downhole environment. The mobility platform also includes a computing module configured to receive the command and to determine a first width of an upcoming portion of the downhole environment from the feature. The mobility platform further includes a drive module having extendable and retractable tractor treads. The computing module is further configured to control the drive module to extend or retract the tractor treads to a second width less than a first width to fit the mobility platform in the upcoming portion of the downhole environment. The computing module is responsive to the received command to control the drive module to drive the tractor treads to move the mobility platform to and within the upcoming portion of the downhole environment. The sensor module includes a camera for capturing an image of the downhole environment. The computing module is further configured to transmit the image to the control apparatus, which includes a display and displays the image on the display. The displayed image is conveyable to the user. The controller is further configured to await a second command whether to move the mobility platform into the upcoming portion of the downhole environment. The sensor module, computing module, and drive module can be interconnected. The sensor module, computing module, and drive module can be removably interconnected. Each of the sensor module, computing module, and drive module have housings that are substantially cylindrical with a respective module longitudinal axis. The sensor module, computing module, and drive module are interconnected with the respective longitudinal axes substantially aligned to form the mobility platform and to define a substantially cylindrical shape along a mobility platform longitudinal axis. The tractor treads are extended or retracted laterally relative to the mobility platform longitudinal axis. The sensor module includes a sensor emitting a detection signal in a forward direction at an acute angle to the mobility platform longitudinal axis for detecting the feature. The computing module controls the drive module using wireless signals.

In a further embodiment, a method comprises interconnecting a plurality of modules. The plurality of modules comprise at least a drive module. The interconnected modules define a mobility platform. The method further includes deploying the mobility platform into a downhole environment, detecting a feature of the downhole environment, determining a width of an upcoming portion of the downhole environment, moving a tractor tread from the drive module to fit the mobility platform into the upcoming portion, and advancing the mobility platform into the upcoming portion of the downhole environment. The moving of the tractor tread comprises either extending the tractor tread from the drive module or retracting the tractor tread toward the drive module prior to advancing the mobility platform into the upcoming portion of the downhole environment.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

It is noted that the drawings are illustrative and are not necessarily to scale.

DETAILED DESCRIPTION OF CERTAIN EMBODIMENTS OF THE DISCLOSURE

Example embodiments consistent with the teachings included in the present disclosure are directed to a modular mobility platform capable of traveling through diverse downhole environments, as well as a system and method using such a modular mobility platform.

Figure 3:
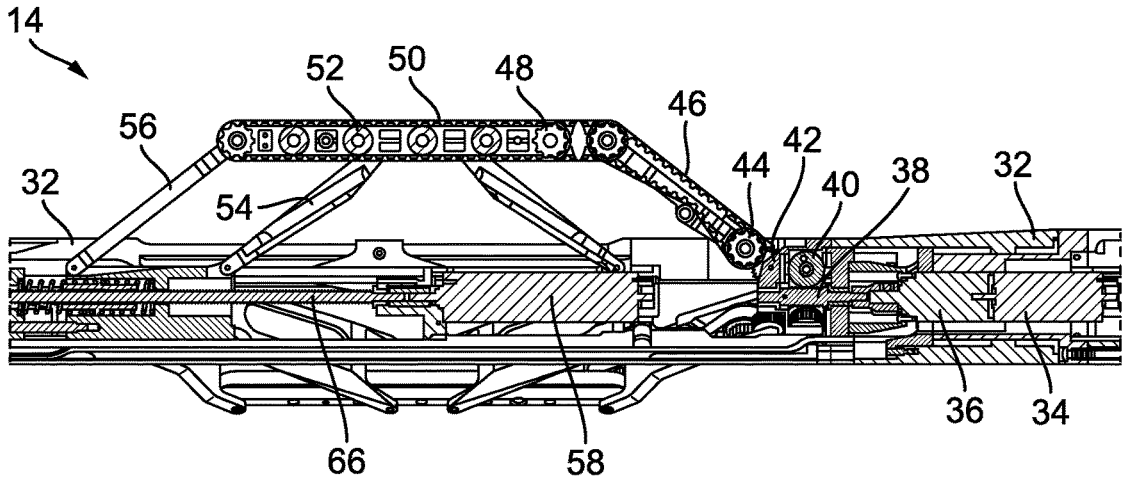
FIG. 3 is a side cross-sectional view of a drive module of the platform with the tractor treads in a partially extended configuration.
Figure 4:
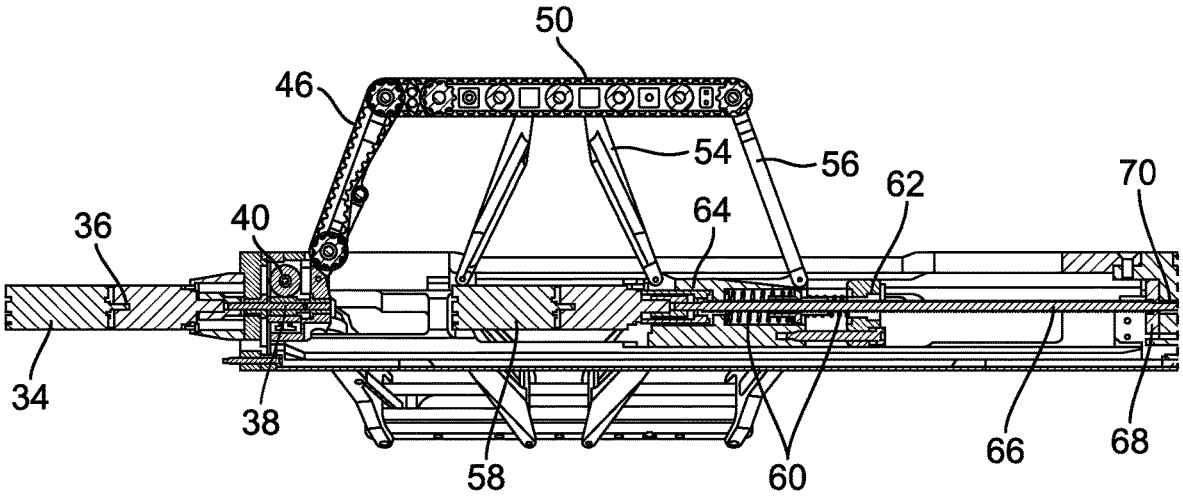
FIG. 4 is a side cross-sectional view of the drive module of FIG. 3 with the tractor treads in a fully extended configuration.
Figure 5:
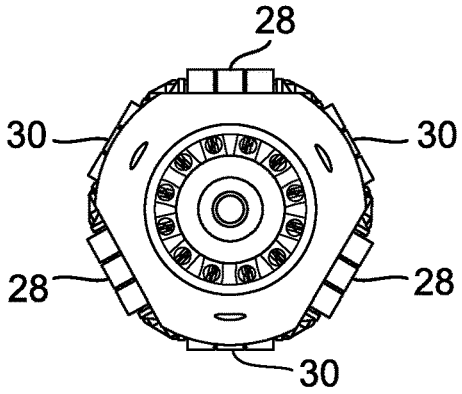
FIG. 5 is a forward elevational view of the mobility platform in the retracted configuration of FIG. 1.

As shown in FIGS. 1-12, the mobility platform 10 includes a plurality of interconnected modules 12-20 for traveling through downhole environments having diverse geometries. The modules 12-20 have respective housing that are generally cylindrical and elongated with longitudinal axes, or that are sized so that the overall shape of the mobility platform 10 can be defined as a generally cylindrical robot, as illustrated. When interconnected with one end of a module to an end of another module, the modules 12-20 constitute the mobility platform 10 which, as noted, is generally cylindrical and elongated. The modules 12-20 can be removably connected such that the modules 12-20 are secured to each other to form the platform 10. Such cylindrical and elongated configurations of the platform 10 and its modules 12-20 have a common longitudinal axis, and a minimum lateral width of, for example, about 2.585 inches (about 6.566 cm.), as shown in FIG. 5. Such a minimum lateral width allows the platform 10 to pass through a downhole environment of a larger lateral width relative to a longitudinal axis of the platform 10.

Figure 1:
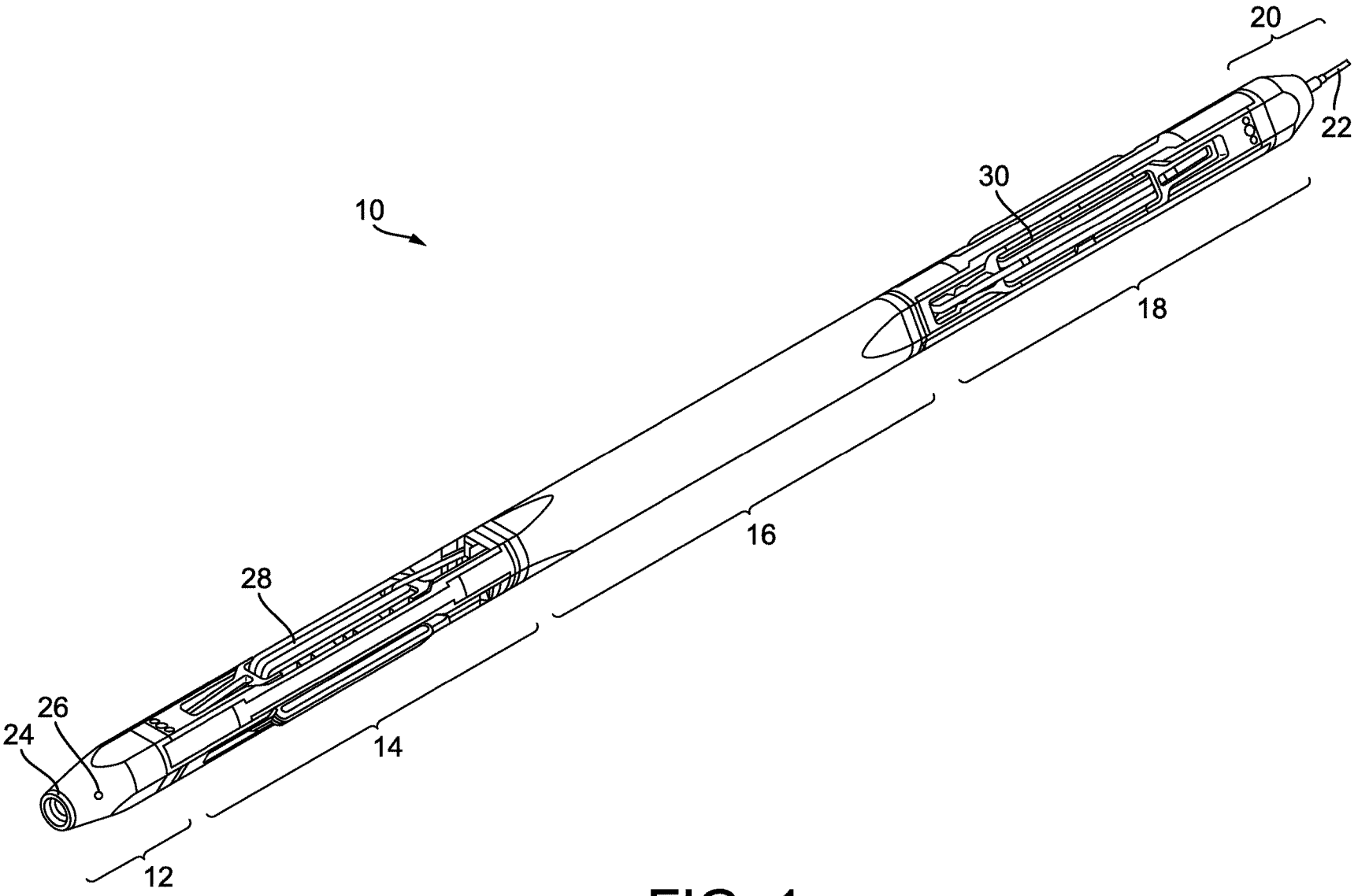
FIG. 1 is a top front side perspective view of a mobility platform with tractor treads in a retracted configuration according to an embodiment.

The mobility platform 10 carries instruments capable of navigating and inspecting the downhole environments. Referring to FIG. 1, the modules can include a sensor module 12, a first drive module 14, a computing module 16, and second drive module 18, and a connector module 20 which is attached to a tether from a rig above ground on the surface of the Earth. The sensor module 12 is positioned at a front end of the platform 10, and the connector module 20 is positioned at a rear end of the platform 10. Through the tether, the connector module 20 can provide power from the rig to at least the second drive module 18.

The sensor module 12 can include a housing with apertures through which a camera 24 and a Time of Flight (ToF) sensor 26 can detect the downhole environment and local geological geometry at the front end of the platform 10. As with other modules described herein, each is associated with a hardware processor and a memory unit which contains code. The code is loaded from the memory into the processor and configures the processor to implement the functionality of the respective module, such as the sensor module 12.

The sensor module 12 is described in greater detail below with reference to FIGS. 7-12. With the camera 24 and ToF sensor 26, the platform 10 can operate in an autonomous mode, under control of code executing in one or more processors, to move forward and navigate through the downhole environment. Alternatively, the images and ToF data from the camera 24 and ToF sensor 26 can be relayed to an operator outside of the downhole, such as in a position on the surface of the Earth. Accordingly, the platform 10 can operate in a semi-autonomous mode by which the operator processes the images and ToF data, and instructs the platform 10, through communications transmitted through the tether 22, to move forward or backward within the downhole environment. As such, in this alternative arrangement, the platform operates under control of code executing in one or more processors and, further, in compliance with any commands that may have been received from a user. In a further alternative embodiment constructed with at least one processor executing locally on the platform 10, the operator instructs the platform 10 using signals provided to the computing module 16 to locally control the movement of the platform 10. Such signals can be radio waves.

Figure 2:
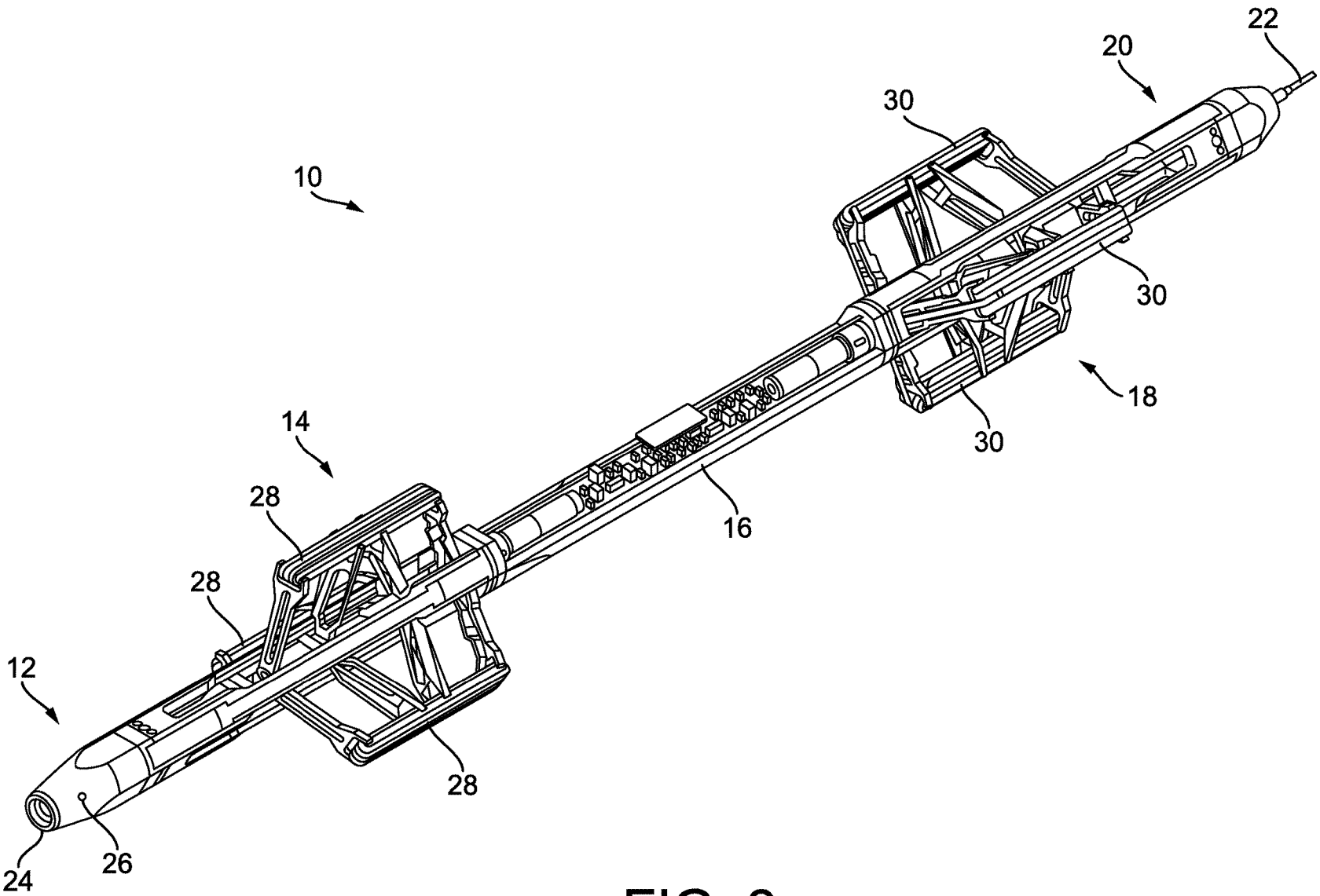
FIG. 2 is a top front side perspective view of the mobility platform of FIG. 1 with the tractor treads in a fully extended configuration.

Referring again to FIG. 1, the drive modules 14, 18 can include tractor treads 28, 30, respectively, which can be retracted or extended laterally relative to the longitudinal axis. FIG. 1 is a top front side perspective view of a mobility platform 10 with the tractor treads 28 in a retracted configuration, and FIG. 2 is a top front side perspective view of the mobility platform 10 with the tractor treads 30 in a fully extended configuration. In the example embodiment of FIGS. 1-2, the retraction and extension of the tractor treads 28, 30, as well as the motive operation of the tractor treads 28, 30 is controlled by the computing module 16. The computing module 16 is associated with a hardware processor and a memory unit which contains code, and this can be the same processor and memory used by other modules, or a different processor and memory. The computing module implements code loaded from the memory which configures the processor to implement the functionality of the computing module 16, including control of a drive module or of plural drive modules. In an alternative embodiment, since the platform 10 is modular, the platform 10 can accommodate any number of drive modules such as the drive modules 14, 18 required for the specific application of the platform 10 in the downhole environment. For example, modules can be linked together with one computing module for every two drive modules. The specific applications can include cameras and other types of detectors which are laterally oriented on a computing module for inspecting the walls of the well or pipe. Alternatively, the lateral cameras and detectors can be included in a detection module configured differently from the computing module. An alternative application can include a repair module having laterally retractable and extendable arms for repairing a wall or the well or pipe.

In an embodiment, shown in FIGS. 1-2, each drive module 14, 18 has three tractor treads 28, 30, respectively. The three tractor treads of a specific drive module are spaced about the longitudinal axis by, for example, about 120°, as shown in FIG. 2. Such angular differences between the treads of a specific drive module provide greater stability of the respective drive module when the arms including the treads of the respective drive module are extended and pre-loaded against the downhole walls. In an alternative embodiment, a drive module can have two tractor treads spaced about the longitudinal axis by about 180°. In a further alternative embodiment, a drive module can have four tractor treads spaced about the longitudinal axis by about 90°. In another alternative embodiment, a drive module can have only one tractor tread. In additional alternative embodiments, a drive module with at least two tractor treads can have such tractor treads spaced about at diverse angles. In an example of such diverse angular configurations, the three tractor treads 28 of the first drive module 14 in FIG. 2 can have two tractor treads spaced about the longitudinal axis by about 180°, and the third tractor tread spaced about the longitudinal axis by about 90° from the other two tractor treads, forming a "T" configuration of tractor treads.

Figure 6:
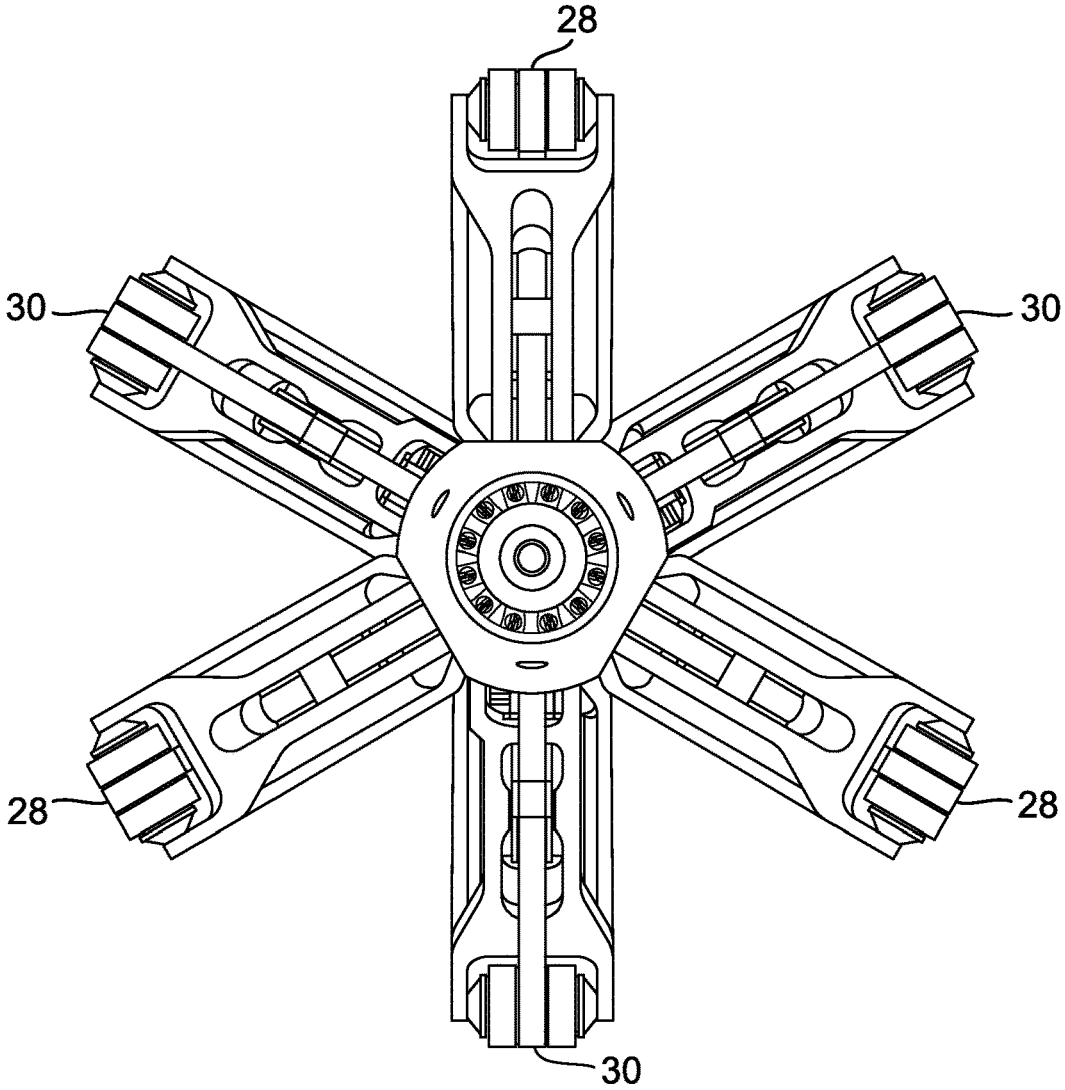
FIG. 6 is a forward elevational view of the mobility platform in the fully extended configuration of FIG. 2.
Figure 7:
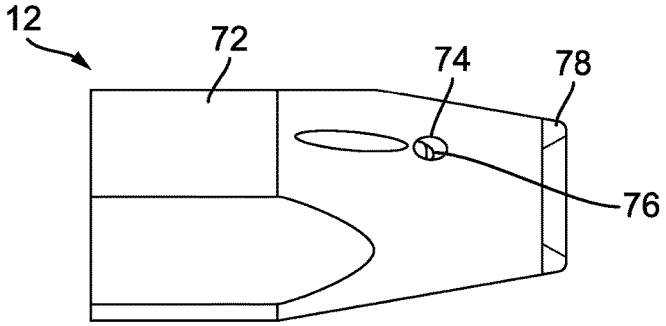
FIG. 7 is a side elevational view of a sensor module of the mobility platform.
Figure 8:
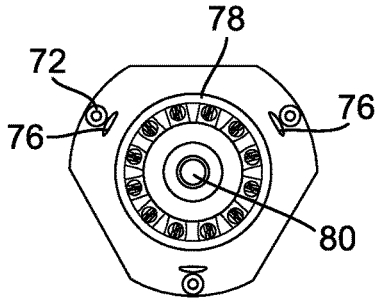
FIG. 8 is a front elevational view of the sensor module of FIG. 7.

In an embodiment as shown in FIGS. 1-2, the second drive module 18 is configured to have the tractor treads 30 rotated by an angle relative to the longitudinal axis and relative to the tractor treads 28 of the first drive module 14. For example, as shown in FIGS. 5-6, the tractor treads 28, 30 are spaced about 60°. Such angular differences between the treads 28, 30 provide greater stability of the overall platform 10 when the arms including the treads 28, 30 are extended and pre-loaded against the downhole walls.

Each drive module 14, 18 has two subsystems: a preload system and a drive system. The drive system actuates the treads 28, 30 on each of the modules 14, 18, respectively, using a worm-gear drive, allowing the platform 10 to move longitudinally forward and backward. The drive module(s) are associated with a hardware processor and a memory unit which contains code. The code is loaded from the memory into the processor and configures the processor to implement the functionality of the drive modules 14, 18. As noted above, the processor and memory can be dedicated to the respective drive modules 14, 18, or can be associated with other modules, depending on the particular implementation approach.

Under control of code executing to implement each respective drive module, each of the treads 28, 30 on arms of the drive modules 14, 18, respectively, can retract and extend independently, although the treads of a specific drive module are linked together by the worm gear drive for radial symmetry. Also under control of code executing to implement each respective drive module, the preload system controls the lateral distance of the platform 10 from the downhole walls by extending and retracting the arms of each drive module. The preload system and the drive system are actuated using one motor for each subsystem in the illustrated embodiment. Under control of code executing each respective drive module, a preload motor turns the leadscrew and applies a preload of the treads against the downhole wall by moving the arms radially. In addition, under control of code executing each respective drive module, a drive motor is energized to drive the mobility platform 10 so as to move forward or in reverse in a direction parallel to the mobility platform longitudinal axis by moving the treads 28, 30.

Referring to FIGS. 3-4 for an example drive module, such as the drive module 14, FIG. 3 is a side cross-sectional view of the drive module 14 with the tractor treads 28 in a partially extended configuration. FIG. 4 is a side cross-sectional view of the drive module 14 with the tractor treads 28 in a fully extended configuration. The drive module 14 has a housing 32 which includes, as the drive subsystem, a drive motor 34, a drive motor gearhead 36, a triple-drive worm gear 38, a drive pinion gear 40, a linkage idler gear 42, a linkage drive gear 44, a transmission belt 46, a track belt pulley 48, a drive belt 50, and at least one belt roller 52.

As shown in FIGS. 3-4, the drive subsystem of the drive module 14 is configured by code to provide for actuation of the drive belt 50, as the tread 28, wrapped around each of the three arms of the drive module 14, is driven by a motor. The three treads 28 are driven by, for example, a Maxon brushless EC-max 22 DC, as the drive motor 34, and are paired with a high-power planetary gearhead 36 with the reduction ratio of 128:1 in the illustrated embodiment as an example and not a constraint on any given implementation. The drive shaft of the gearhead 36 is connected to a worm gear 38. The triple-drive worm gear 38 meshes with three drive pinion gears 40 for symmetrical transmission of torque, with each pinion gear 40 providing the torque to actuate one of the three treads 28 on the drive module 14. The pinion gear 40 then transmits torque to an idler gear 42 which then meshes with a linkage drive gear 44 which directly drives the transmission belt 46. The transmission belt 46 then rotates the track belt pulley 48 to move the drive belt 50, as the tread 28, on a belt roller 52. Since the gear ratios in the drive subsystem are approximately 1:1, there is little to no rotational speed reduction and hence no increase in torque between the worm gear 38 and linkage drive gears 44. Therefore, a high-power gearhead 36 is used with a large reduction ratio.

As shown in FIGS. 3-4, the preload subsystem includes arms 54, 56 which are extended or retracted radially relative to the longitudinal axis of the drive module 14. The arms 54, 56 are moved radially by a lead-screw motor having a gearhead 58. The gearhead 58 is connected to a lead screw 66 with dual preload springs 60 biasing the gearhead 58. The lead screw 66 passes through a lead-screw nut 62, and a lead-screw bushing 70 having a load cell 68.

The preload subsystem allows the arms having the treads 28 to extend to accommodate the various diameters that the platform 10 is expected to have the ability to traverse, as well as to retract to be stowed during traversal of a narrow well, such as a XN Nipple. The preload subsystem translates the three treads 28 radially towards/away from longitudinal axis. On each drive module 14, all three treads 28 are coupled and move together. The treads cannot be extended or retracted individually. However, the preload subsystem for each drive module can be extended or retracted independently of the other drive modules of the platform 10.

The preload subsystem of each drive module 14, 28 is driven by a motor. For example, the motor can comprise the Maxon brushless EC-max 22 DC motor 36. For the preload motor 36 in the illustrated embodiment, the planetary gearhead 6 with, for example, a reduction ratio of 128:1 is used to reduce the rotational speed and increase the torque of the leadscrew 66. The torque transmission starts at the brushless DC motor 36, when the paired planetary gearhead 36 turns the leadscrew 66, thereby moving the leadscrew nut 62 forward or backward along the longitudinal direction. The leadscrew nut 62 is threaded while the linkage slider 64 floats freely on the leadscrew 66. The leadscrew 66 and the leadscrew nut 62 are fastened with three shoulder screws that provide a gap for the preload compliance springs 60. As the leadscrew 66 moves, the nut 62 compresses the dual preload springs 60. The preload springs 60 then apply a force to the base of the actuation arms 54, 56. The lateral distance of the platform 10 from a downhole wall is controlled by moving the leadscrew nut 62 along the longitudinal direction. The preload force on the treads 28 pushes the arms 54, 56 downward towards the longitudinal axis, which in turn compresses the springs 60 and applies pressure on the loadcell 68 embedded within the leadscrew nut 62. The applied pressure on the loadcell 68 allows for a measurement of a preload force of the tread 28 against the downhole wall. The objective is to maintain a constant preload value by controlling the operating current of the drive motor 34, and reading the load values from the embedded loadcell 68.

The preload subsystem has both active and passive compliance. The passive compliance is in the preload springs 60 which float between the leadscrew nut 62 and the linkage slider 64 allowing the linkage arms 54, 56 some freedom of movement even when the nut 62 is fixed in position. The active compliance is in the constant adjustment of operating current of the drive motor 34 according to the readings from the loadcell 68 embedded in the leadscrew nut 62 and keeping the preload value within an optimal range.

In an alternative embodiment, a limit switch can be positioned in the housing 32 of the drive module 14. The limit switch can be triggered when the leadscrew nut 62 is in the fully collapsed position and is used mainly for homing purposes. After the homing procedure is complete, the position of the limit switch can be known, for example, with the treads 28 in a fully-retracted position. The drive motor 34 can include hall sensors in certain embodiments. Using pulse-counting on the hall sensors, the fully extended position of the nut 62 can be calculated within an on-board processor. Software executing in the computing module 16 can implement soft stops before the leadscrew nut 62 reaches two integral positions.

Referring to FIGS. 5-6, FIG. 5 is a forward elevational view of the mobility platform 10 with the treads 28, 30 in the retracted configuration of FIG. 1, and FIG. 6 is a forward elevational view of the mobility platform 10 with the treads 28, 30 in the fully extended configuration of FIG. 2. For transitioning between downhole environments of different lateral widths, the mobility platform 10 utilizes a continuous drive mechanism while travelling through a downhole environment such as a pipe, under control of the program executing in its associated processor, optionally in compliance with any command from a user that may have been received. For example, both drive modules 14, 18 are driven simultaneously for uninterrupted linear movement. While moving from one downhole size to another, the platform 10, using one or more sensors in a suitably configured module such as the sensor module 12, detects the transition, and issues control signals to the computing module 16 to either retract or extend the treads 28, 30 on the arms 54, 56 depending on the transition type. In one example, the treads 28, 30 are retracted to pass through an XN-nipple, and are extended to preload against open-hole or washout.

As shown in FIG. 5, the minimum width of the platform 10 is about 2.585 inches (about 6.566 cm.), while the maximum width is about 8.6 inches (about 21.84 cm.), as shown in FIG. 6. Such a maximum diameter of the fully extended platform 10 is slightly less than an average washout width of about 9 inches (about 22.86 cm.). Alternatively, the drive modules 14, 28 can have longer linkages such as longer arms 54, 56 to accommodate a wider range of downhole widths.

Transversal of an XN-nipple requires at least two drive modules, since one of the drive modules needs to be extended and preloaded against the pipe wall to support the platform 10, while the other drive module is retracted to pass through the constriction of the XN-nipple. No matter how many drive modules are incorporated into a different configuration of the platform 10, the process of passing through a constriction remains the same. Each drive module retracts and passes through the XN-nipple while being supported by the other drive modules. Such retraction and extension of arms 54, 56 and treads 28, 30 can be performed for each drive module until the end of the platform 10 clears the constriction of a narrow downhole environment such as an XN-nipple.

For the drive modules 14, 18, power to the motor 36 can be supplied by at least one battery internal to the drive modules 14, 18. The battery can be rechargeable. Alternatively, for any drive module attached to the connector 20, such as the drive module 18 in FIGS. 1-2, power can be supplied directly to the motor 36 by electrical connections through the connector 20 from the tether 22. In a further alternative embodiment, power supplied from the tether 22 through the connector 20 can charge a rechargeable battery internal to the drive module 18. Power can be conveyed to each of the respective modules by an electrical connection associated with the interconnection of any particular arrangement of modules.

Referring to FIGS. 1-2, the computing module 16 is positioned in an intermediate location among the various modules 12-20 of the platform 10. The computing module 16 includes a housing for retaining a motor controller, a core processing unit ("processor," as previously described), and memory for storing code, settings, and data collected during the downhole travel, all connected to the motor controller. This is used to control the nearby drive modules 14, 18. The housing can be composed of aluminum. The computing module 16 can also include a separate heat sink thermally connected to the aluminum housing for dissipating heat during operation of the platform 10. In an alternative embodiment, a heat sink pattern is milled into an aluminum base of the computing module 16 to ensure good thermal contact and heat dissipation during operation of the platform 10. In an embodiment, the computing module 16 has no external sensors or effectors, and so is dedicated to communicating with and controlling other modules in the platform 10. In an alternative embodiment, the computing module 16 can include external sensors or effectors for detecting and performing actions, respectively, in intermediate locations in the downhole environment relative to the overall length of the platform 10.

Each end of the computing module 16 is connected to an adjacent drive module 14, 18, respectively. The motor controller can be directly connected to the drive motor 34 of an adjacent drive module, such as the drive module 14. Accordingly, signals from the motor controller are communicated to the drive motor 34 to control the application of electricity from the battery of the drive module 14 to the drive motor 34. In an alternative embodiment, the motor controller and the drive motor 34 can be connected to respective wireless communication units. Using the wireless communication units, the motor controller can wirelessly control the drive motor 34 of the drive module 14. The wireless control can be performed using WIFI, BLUETOOTH, or other known communication protocols.

Using the motor controller and the core processing unit, the computing module 16 can perform local, closed loop motion and preload control by virtue of the logic being implemented by the code executing in the processor. In conjunction with data gathered from the sensor module 12, the platform 10 implements autonomous position estimation of the platform 10, downhole feature detection, and downhole feature navigation, or, in certain implementations, semi-autonomous downhole feature navigation in response to commands received from a remote user. Using the data gathered from the sensor module 12, the code executing in the processor of the computing module 16 determines a feature in an upcoming portion of the downhole environment. The code determines a width of the upcoming portion of the downhole environment from the feature. The computing module 16 uses first predetermined logic implemented by the code executing in the processor. By using the first predetermined logic, the computing module 16 generates a first signal, transmitted to the drive modules 14, 18, which causes the arms 54, 56 and treads 28, 30 to extend or retract in order to preload the treads 28, 30 against the walls of the downhole environment to fit the mobility platform 10 into the upcoming portion. The computing module 16 uses second predetermined logic implemented by the code executing in the processor. By using the second predetermined logic, the computing module 16 generates a second signal, transmitted to the drive modules 14, 18, to rotate the treads 28, 30. The treads 28, 30 are preloaded against the walls of the downhole environment. Accordingly, the mobility platform 10 advances into the upcoming portion of the downhole environment.

Figure 9:
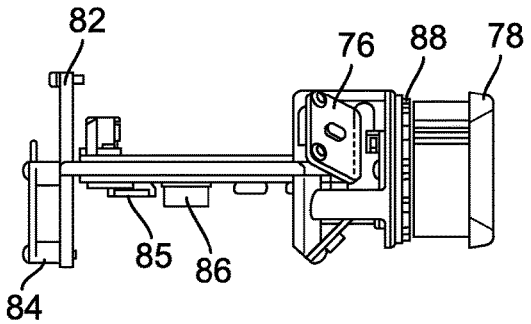
FIG. 9 is a side elevational view of the components of the sensor module of FIG. 7.
Figure 10:
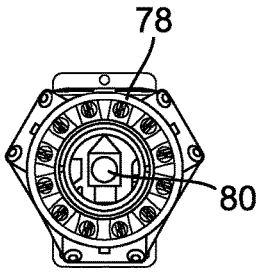
FIG. 10 is a front elevational view of the components of the sensor module of FIG. 7.
Figure 11:
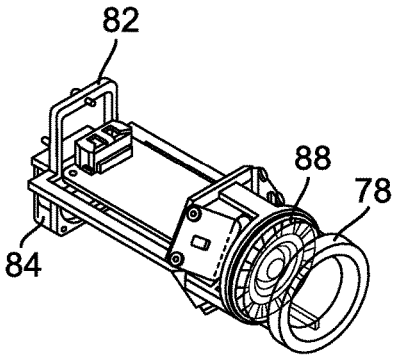
FIG. 11 is a front top side perspective view of the components of the sensor module of FIG. 7.

Referring to FIGS. 7-12, the sensor module 12 includes a housing 72 with an aperture 74 in which is disposed at least one ToF sensor 76. In an embodiment, the sensor module 12 as three ToF sensors 76 spaced about 120° around the longitudinal axis of the sensor module 12. Referring to FIGS. 7-11, a light diffusor 78 is positioned at the front of the housing 72. A camera 80 can obtain images through an open central region of the light diffusor 78. Referring to FIGS. 9-11, an inner chassis 82 supports the components within the housing 72. A cooling fan 84 cools the electronic components in the housing 72. A processor 85 which implements code is configured to interact with the ToF sensor 76 and the camera 80 to collect distance data and images, respectively.

The processor 85 includes a wireless communication device 86 for wirelessly transmitting the distance data and images to the computing module 16. In addition, the wireless communication device 86 receives control signals from the computing module 16 for controlling the components within the sensor module 12. The wireless communication device 86 has an antenna for transmitting and receiving signals using WIFI, BLUETOOTH, or other known communication protocols.

Figure 12:
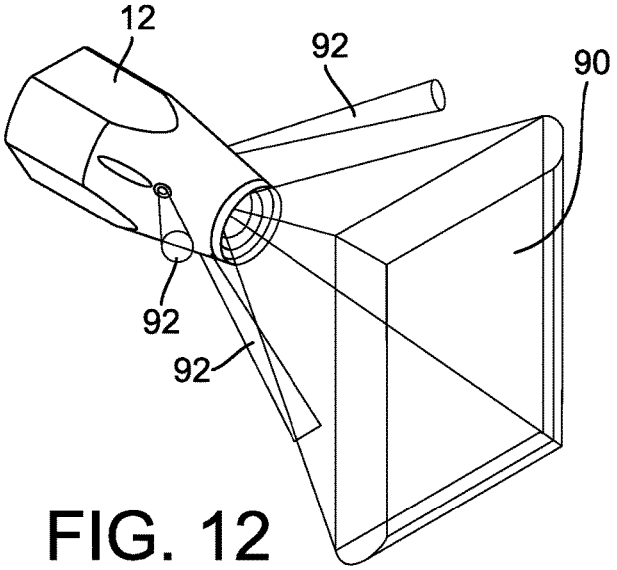
FIG. 12 is a front top side perspective view of representation of the ranges of detection of the sensor module of FIG. 7.

The housing 72 also includes a ring 88 of light emitting devices, such as light emitting diodes (LEDs), incandescent lights, or other known light emitting devices. The ring 88 extends around the longitudinal axis of the sensor module 12, and is configured to emit light which is then diffused by the light diffusor 78. The ring 88 and light diffusor 78 illuminate the frontward direction of the sensor module 12, allowing the camera 80 to capture images in the frontward direction of the platform 10. FIG. 12 illustrates a Field of View (FoV) 90 of the camera 80 in the frontward direction. Such images are then transmitted by the processor 85, using the wireless communication device 86, to the computing module 16. The camera 80 can be, for example, an 8 Megapixel camera. The camera 80 can capture still images. Alternatively, the camera 80 can be a video camera which can stream real-time video from the front perspective of the platform 10.

Each ToF sensor 76, as a range sensor, can emit signals through the aperture 74, in a range 92 represented in FIG. 12. The emitted signals are transmitted in a forward direction at an acute angle of, for example, about 45° relative to the longitudinal axis of the platform 10. The emitted signals can be light, radio waves, microwaves, or ultrasound which are reflected by forward-located features in the downhole environment. The reflected signals are detected by the ToF sensor 76, and converted to be the distance data transmitted to the computing module 16. The ToF sensor 76 allows the platform 10 to estimate the width of the downhole environment in front of the platform 10, which improves the fidelity of the preload system and allows for autonomous traversal of downhole environments with different widths, such as an XN-Nipple.

Referring to FIGS. 1-2, the connector module 20, disposed in the rear end of the platform 10, can also include at least one ToF sensor as a range sensor, operating in a manner identical to the at least one ToF sensor 76. Such a configuration of the connector module 20 with a ToF sensor allows the platform 10 to detect rearward downhole features when the platform 10 moves rearward, for example, during extraction of the platform 10 from the downhole environment. In an embodiment, the connector module 20 does not include a camera or a light-emitting ring, due to the presence of the tether 22. In an alternative embodiment, the connector module 20 can include a camera and a light emitting ring, with the camera having a FoV directed off of the longitudinal axis of the platform 10 to accommodate the presence of the tether 22.

Figure 13:
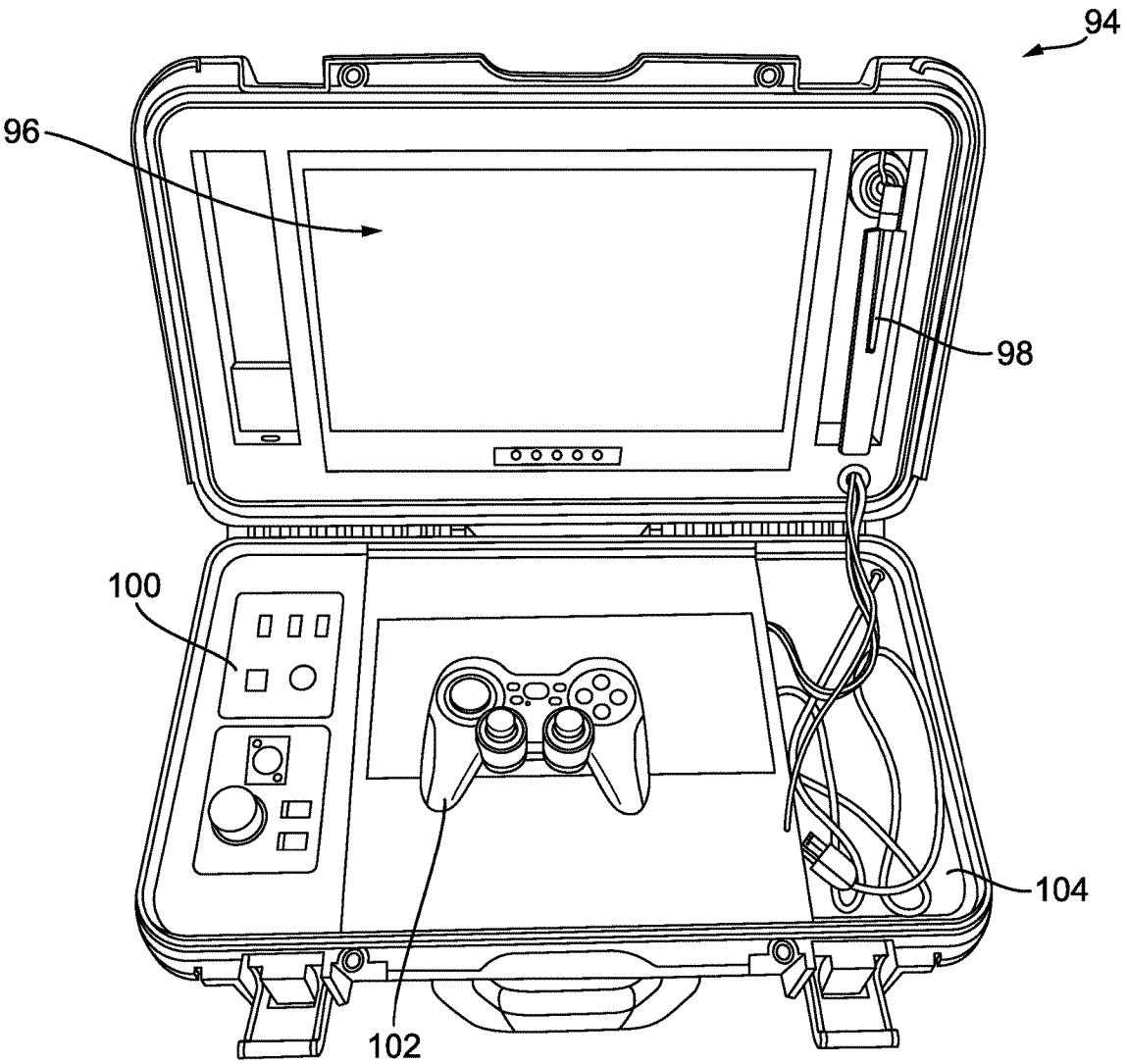
FIG. 13 is a top front view of a control apparatus for the mobility platform.
Figure 14:
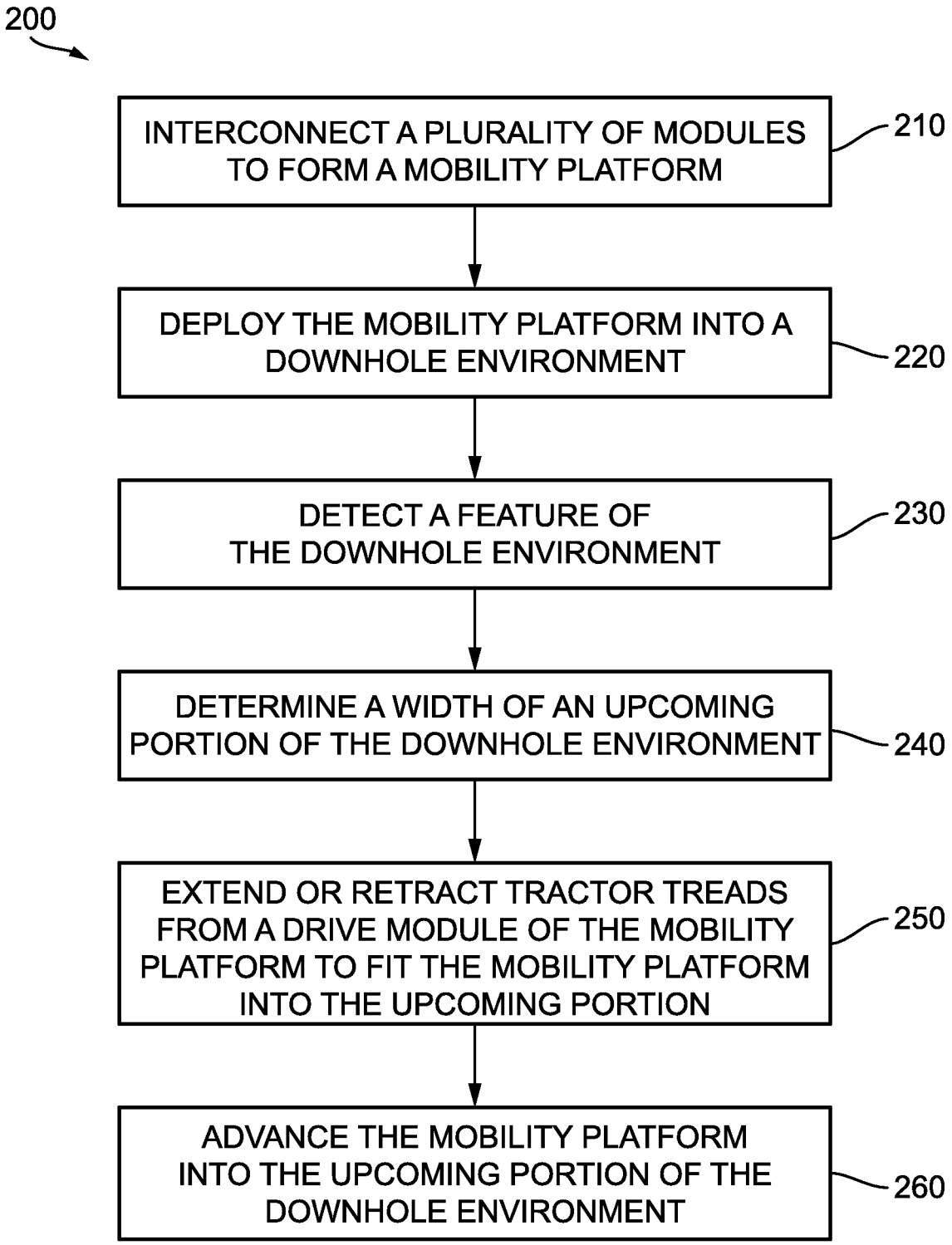
FIG. 14 is a flowchart of a method for operating the mobility platform.

The present disclosure also includes a system having at least the mobility platform 10 and a control apparatus 94, shown in FIG. 13. The platform 10 is in communication with the control apparatus 94, for example, by wireless communications from the computing module 16. Alternatively, the platform 10 can transmit data to the apparatus 94 through the tether 22. The control apparatus 94 includes a display 96, a wireless antenna 98, a control panel 100, and a hand-held controller 102 mounted in a housing 104. The housing 104 can be adapted to be a carry case for transporting the control apparatus 94 to a site where the platform 10 is to operate.

The display 96 can display images from the camera 80, and can also display distance data from the measurements of the ToF sensor 76. The wireless antenna 98 is configured to operate at the frequency of the wireless communications of the computing module 16. Through the wireless antenna 98, the control apparatus 94 can communicate with the computing module 16 using WIFI, BLUETOOTH, or other known communication protocols. The hand-held controller 102 can be a teleop joystick, resembling a game controller, for instructing the mobility platform 10 to move forward or rearward.

The present disclosure also includes a method 200 for operating the mobility platform 10. The method 200 includes the step of interconnecting a plurality of modules to form the mobility platform 10, including a sensor module, a drive module, and a computing module in step 210. The step of interconnecting can include physically joining discrete modules with a rigid coupling or a joint which allows relative angles to be achieved from one module to a next during traversal of a downhole environment. The method includes deploying the so-connected modules as a unified mobility platform 10 into a downhole environment in step 220. Once in the downhole environment, the method includes detecting a feature of the downhole environment in step 230, determining a width of an upcoming portion of the downhole environment in step 240, and extending or retracting tractor treads from a drive module in step 250 in order to fit the mobility platform 10 within the upcoming portion of the downhole environment. Each of these steps can be implemented using the modules described above. The method proceeds with the mobility platform 10 advancing into the upcoming portion of the downhole environment in step 260.

Portions of the methods described herein can be performed by software or firmware in machine readable form on a tangible (e.g., non-transitory) storage medium. For example, the software or firmware can be in the form of a computer program including computer program code adapted to cause the modular mobility platform to perform various actions described herein when the program is run on a computer or suitable hardware device, and where the computer program can be embodied on a computer readable medium. Examples of tangible storage media include computer storage devices having computer-readable media such as disks, thumb drives, flash memory, and the like, and do not include propagated signals. Propagated signals can be present in a tangible storage media. The software can be suitable for execution on a parallel processor or a serial processor such that various actions described herein can be carried out in any suitable order, or simultaneously.

It is to be further understood that like or similar numerals in the drawings represent like or similar elements through the several figures, and that not all components or steps described and illustrated with reference to the figures are required for all embodiments or arrangements.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "contains", "containing", "includes", "including," "comprises", and/or "comprising," and variations thereof, when used in this specification, specify the presence of stated features, integers, steps, operations, elements, and/or components, but do not preclude the presence or addition of one or more other features, integers, steps, operations, elements, components, and/or groups thereof.

Terms of orientation are used herein merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third) is for distinction and not counting. For example, the use of "third" does not imply there is a corresponding "first" or "second." Also, the phraseology and terminology used herein is for the purpose of description and should not be regarded as limiting. The use of "including," "comprising," "having," "containing," "involving," and variations thereof herein, is meant to encompass the items listed thereafter and equivalents thereof as well as additional items.

While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims.

The subject matter described above is provided by way of illustration only and should not be construed as limiting. Various modifications and changes can be made to the subject matter described herein without following the example embodiments and applications illustrated and described, and without departing from the true spirit and scope of the invention encompassed by the present disclosure, which is defined by the set of recitations in the following claims and by structures and functions or steps which are equivalent to these recitations

What is claimed is:

1. A mobility platform having a mobility platform longitudinal axis and capable of traveling in a downhole environment, comprising:

a sensor module having a sensor housing disposed at a distal end of the mobility platform, wherein the sensor module is configured to detect a feature of the downhole environment;

a first drive module having a first drive housing disposed along the mobility platform longitudinal axis adjacent to the sensor housing and having three first tractor treads extendable out from the first drive housing and retractable into the first drive housing, wherein the three first tractor treads are spaced 120 degrees apart from each other about the mobility platform longitudinal axis;

a second drive module having a second drive housing disposed along the mobility platform longitudinal axis and having three second tractor treads extendable out from the second drive housing and retractable into the second drive housing, wherein the three second tractor treads are spaced 120 degrees apart from each other about the mobility platform longitudinal axis, and wherein the three second tractor treads are rotated by a non-zero angle relative to the mobility platform longitudinal axis to be spaced by the non-zero angle relative to the three first tractor treads; and a computing module having a computing housing disposed along the mobility platform longitudinal axis between the first and second drive housings and configured to determine a first width of an upcoming portion of the downhole environment from the feature;

wherein the computing module is further configured to:

control the first and second drive modules to extend the first and second tractor treads from the first and second drive housings, respectively, or retract the first and second tractor treads into the first and second drive housings, respectively, to have a second width less than a first width to fit the mobility platform in the upcoming portion, and control the first and second drive modules to drive the first and second tractor treads to move the mobility platform in the upcoming portion.

2. The mobility platform of claim 1, wherein the sensor module, computing module, and drive module are interconnected.

3. The mobility platform of claim 2, wherein the sensor module, computing module, and drive module are removably interconnected.

4. The mobility platform of claim 1, wherein each of the sensor housing, computing housing, and drive housing is substantially cylindrical with a respective module longitudinal axis.

5. The mobility platform of claim 4, wherein the sensor module, computing module, and drive module are interconnected with the respective module longitudinal axes substantially aligned to form the mobility platform and to define a substantially cylindrical shape along the mobility platform longitudinal axis.

6. The mobility platform of claim 5, wherein the tractor treads are extended or retracted laterally relative to the mobility platform longitudinal axis.

7. The mobility platform of claim 5, wherein the sensor module includes a sensor emitting a detection signal in a forward direction at an acute angle to the mobility platform longitudinal axis for detecting the feature.

8. The mobility platform of claim 1, wherein the computing module controls the drive module using wireless signals.

9. The mobility platform of claim 1, wherein the non-zero angle is 60 degrees.

10. A system comprising:

a control apparatus having a controller for a user to enter a command; and a mobility platform having a mobility platform longitudinal axis and capable of traveling in a downhole environment and including:

a sensor module having a sensor housing disposed at a distal end of the mobility platform, wherein the sensor module is configured to detect a feature of the downhole environment;

a first drive module having a first drive housing disposed along the mobility platform longitudinal axis adjacent to the sensor housing and having three first tractor treads extendable from the first drive housing and retractable into the first drive housing, wherein the three first tractor treads are spaced 120 degrees apart from each other about the mobility platform longitudinal axis;

a second drive module having a second drive housing disposed along the mobility platform longitudinal axis and having three second tractor treads extendable from the second drive housing and retractable into the second drive housing, wherein the three second tractor treads are spaced 120 degrees apart from each other about the mobility platform longitudinal axis, and wherein the three second tractor treads are rotated by a non-zero angle relative to the mobility platform longitudinal axis to be spaced by the non-zero angle relative to the three first tractor treads; and a computing module having a computing housing disposed along the mobility platform longitudinal axis between the first and second drive housings and configured to receive the command and to determine a first width of an upcoming portion of the downhole environment from the feature;

wherein the computing module is further configured to:

control the first and second drive modules to extend the first and second tractor treads from the first and second drive housings, respectively, or retract the first and second tractor treads into the first and second drive housings, respectively, to a second width less than a first width to fit the mobility platform in the upcoming portion of the downhole environment, and responsive to the received command, control the first and second drive modules to drive the first and second tractor treads to move the mobility platform to and within the upcoming portion of the downhole environment.

11. The system of claim 10, wherein the sensor module includes a camera for capturing an image of the downhole environment, wherein the computing module is further configured to transmit the image to the control apparatus, and wherein the control apparatus includes a display and displays the image on the display.

12. The system of claim 11, wherein the displayed image is conveyable to the user and wherein the controller is further configured to await a second command whether to move the mobility platform into the upcoming portion of the downhole environment.

13. The system of claim 10, wherein the sensor module, computing module, and drive module are interconnected.

14. The system of claim 13, wherein the sensor module, computing module, and drive module are removably interconnected.

15. The system of claim 13, wherein the sensor module, computing module, and drive module are interconnected with the respective longitudinal axes substantially aligned to form the mobility platform and to define a substantially cylindrical shape along the mobility platform longitudinal axis.

16. The system of claim 15, wherein the tractor treads are extended or retracted laterally relative to the mobility platform longitudinal axis.

17. The system of claim 15, wherein the sensor module includes a sensor emitting a detection signal in a forward direction at an acute angle to the mobility platform longitudinal axis for detecting the feature.

18. The system of claim 10, wherein each of the sensor housing, computing housing, and drive housing is substantially cylindrical with a respective module longitudinal axis.

19. The system of claim 10, wherein the computing module controls the drive module using wireless signals.

20. A method, comprising:

interconnecting a plurality of modules, the plurality of modules comprising at least a first drive module having a first drive housing having three first tractor treads, a second drive module having a second drive housing having three second tractor treads, a sensor module having a sensor housing, and a computing module having a computing housing, the interconnected modules defining a mobility platform with a mobility platform longitudinal axis, wherein the sensor housing is disposed at a distal end of the mobility platform, the first drive housing is disposed along the mobility platform longitudinal axis adjacent to the sensor housing, and the computing housing is disposed along the mobility platform longitudinal axis between the first and second drive housings;

deploying the mobility platform into a downhole environment;

detecting a feature of the downhole environment using the sensor module;

determining a width of an upcoming portion of the downhole environment using the computing module;

moving the three first tractor treads either out from the first drive housing or into the first drive housing under control of the computing module to fit the mobility platform into the upcoming portion;

moving the three second tractor treads either out from the second drive housing or into the second drive housing under control of the computing module; and advancing the mobility platform into the upcoming portion of the downhole environment, wherein the three first tractor treads are spaced 120 degrees apart from each other about the mobility platform longitudinal axis, wherein the three second tractor treads are spaced 120 degrees apart from each other about the mobility platform longitudinal axis, and wherein the three second tractor treads are rotated by a non-zero angle relative to the mobility platform longitudinal axis to be spaced by the non-zero angle relative to the three first tractor treads.

* * * * *